US011078003B2

(12) United States Patent
Gallacher

(10) Patent No.: US 11,078,003 B2
(45) Date of Patent: Aug. 3, 2021

(54) APPARATUS, SYSTEM, AND METHOD TO CONCEAL THE CONTENTS OF A CONTAINER

(71) Applicant: Scott Eric Gallacher, Draper, UT (US)

(72) Inventor: Scott Eric Gallacher, Draper, UT (US)

( * ) Notice: Subject to any disclaimer, the term of this patent is extended or adjusted under 35 U.S.C. 154(b) by 0 days.

(21) Appl. No.: 15/927,933

(22) Filed: Mar. 21, 2018

(65) Prior Publication Data

US 2019/0291934 A1 Sep. 26, 2019

(51) Int. Cl.
*B65D 77/04* (2006.01)
*B65D 47/08* (2006.01)

(52) U.S. Cl.
CPC ..... *B65D 77/0493* (2013.01); *B65D 47/08* (2013.01)

(58) Field of Classification Search
CPC ..... B65D 77/0493; B65D 77/0486; B65D 77/048
See application file for complete search history.

(56) References Cited

U.S. PATENT DOCUMENTS 9,114,910 B1 * 8/2015 Schommer ..... B65D 77/0493
2005/0178739 A1 * 8/2005 Deir ..... B65D 77/0493 215/6
2007/0095828 A1 * 5/2007 Schapiro ..... B65D 77/0493 220/23.83
2009/0294397 A1 * 12/2009 Wu ..... B65D 81/3222 215/6
2012/0024863 A1 * 2/2012 Cho ..... B65D 21/0204 220/506
2013/0026124 A1 * 1/2013 Wu ..... B65D 81/3222 215/6
2015/0368024 A1 * 12/2015 Bartek ..... B65D 85/72 426/115
2017/0361989 A1 * 12/2017 Moffett, III ..... B65D 25/36

* cited by examiner

*Primary Examiner* — Christopher R Harmon
(74) *Attorney, Agent, or Firm* — Jason P. Webb; Pearson Butler

(57) ABSTRACT

An apparatus to conceal the contents of a container, having first and second containers. The first container has an internal cavity accessible through a first container opening and is configured to hold a first liquid, the first container having a first container coupling element. The second container has an internal cavity, the second container internal cavity configured to hold a second liquid through a second container opening, wherein at least a portion of the second container is receivable through the first container opening into the first container internal cavity in the first container. The second container has a second container coupling element. The first container coupling element of the first container is engageable with the second container coupling element of the second container to selectively couple the second container to the first container. Coupling the second container to the first container conceals the first container opening.

9 Claims, 4 Drawing Sheets

APPARATUS, SYSTEM, AND METHOD TO CONCEAL THE CONTENTS OF A CONTAINER

BACKGROUND OF THE INVENTION

Field of the Invention

The present invention relates to containers, specifically to fluid-bearing containers.

Description of the Related Art

In the related art, it has been known to use containers to contain materials/objects. In some cases, it is desired to conceal the contents of the container. Accordingly, containers have been developed with false bottoms (e.g. fake bottom chests), trick openings (e.g. puzzle boxes), and the like. Some improvements have been made in the field. Examples of references related to the present invention are described below in their own words, and the supporting teachings of each reference are incorporated by reference herein:

What is needed is a system, method, and/or apparatus that solves one or more of the problems described herein and/or one or more problems that may come to the attention of one skilled in the art upon becoming familiar with this specification.

SUMMARY OF THE INVENTION

The present invention has been developed in response to the present state of the art, and in particular, in response to the problems and needs in the art that have not yet been fully solved by currently available apparatuses, systems, and methods. Accordingly, the present invention has been developed to provide an apparatus, system, and method to conceal the contents of a container.

According to one embodiment of the invention, there is an apparatus to conceal the contents of a container, having first and second containers. The first container has an internal cavity accessible through a first container opening and is configured to hold a first liquid, the first container having a first container coupling element. The second container has an internal cavity, the second container internal cavity configured to hold a second liquid through a second container opening, wherein at least a portion of the second container is receivable through the first container opening into the first container internal cavity in the first container. The second container has a second container coupling element. The first container coupling element of the first container is engageable with the second container coupling element of the second container to selectively couple the second container to the first container. Coupling the second container to the first container conceals the first container opening.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent, from the Wowing description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawing(s). It is noted that the drawings of the invention are not to scale. The drawings are mere schematics representations, not intended to portray specific parameters of the invention. Understanding that these drawing(s) depict only typical embodiments of the invention and are not, therefore, to be considered to be limiting its scope, the invention will be described and explained with additional specificity and detail through the use of the accompanying drawing(s), in which.

DETAILED DESCRIPTION OF THE INVENTION

Figure 1:
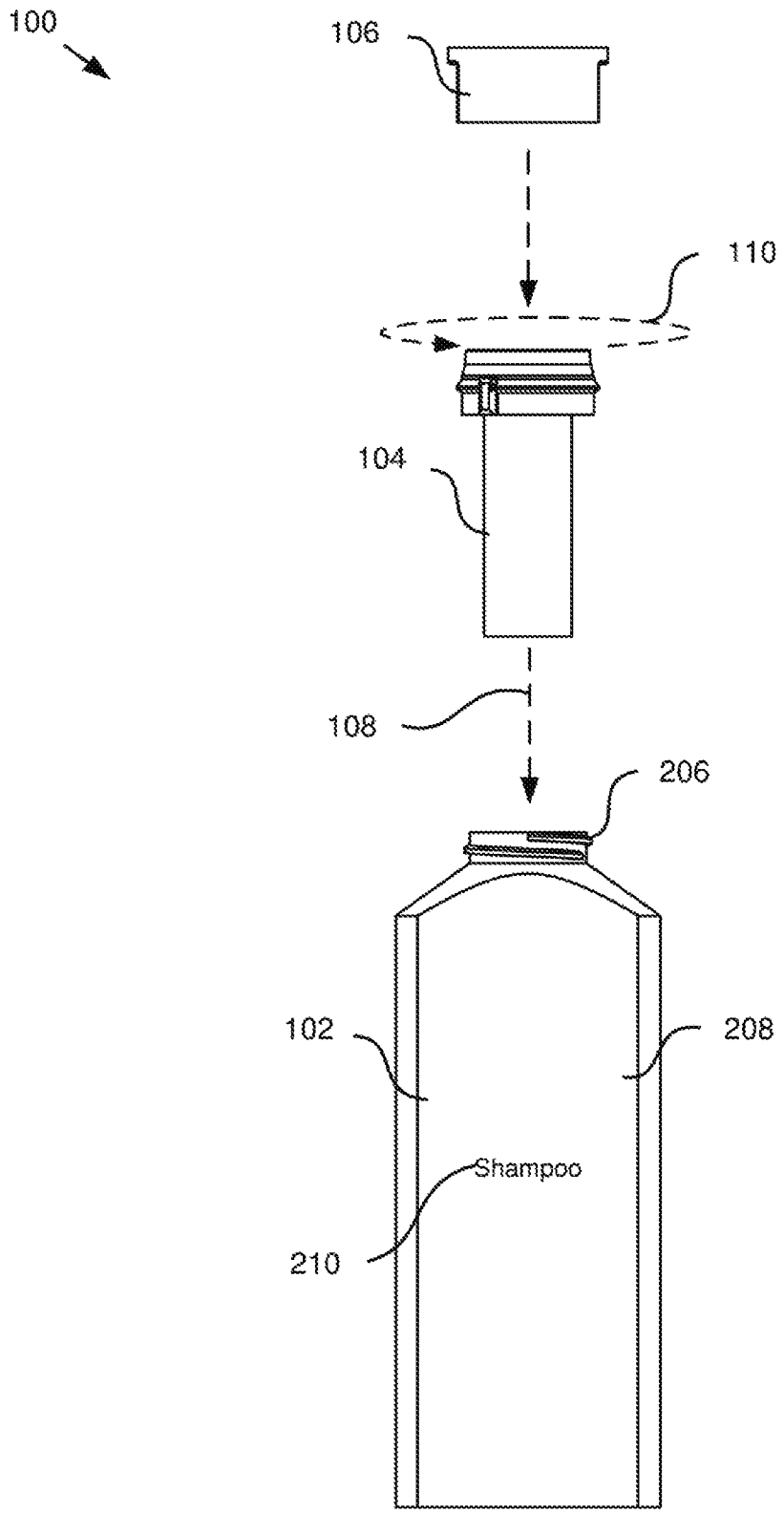
FIG. 1 is a front view illustrating one embodiment of an apparatus to conceal the contents of a container according to one embodiment of the present subject matter.

For the purposes of promoting an understanding of the principles of the invention, reference will now be made to the exemplary embodiments illustrated in the drawing(s), and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to an "embodiment," an "example" or similar language means that a particular feature, structure, characteristic, or combinations thereof described in connection with the embodiment is included in at least one embodiment of the present invention. Thus, appearances of the phrases an "embodiment," an "example," and similar language throughout this specification may, but do not necessarily, all refer to the same embodiment, to different embodiments, or to one or more of the figures. Additionally, reference to the wording "embodiment," "example" or the like, for two or more features, elements, etc. does not mean that the features are necessarily related, dissimilar, the same, etc.

Each statement of an embodiment, or example, is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The features, functions, and the like described herein are considered to be able to be combined in whole or in part one with another as the claims and/or art may direct, either directly or indirectly, implicitly or explicitly.

As used herein, "comprising," "including," "containing," "is," "are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

A hip flask is a thin flask for holding a distilled beverage. Hip flasks were traditionally made of pewter, silver, or even glass, though most modern flasks are made from stainless steel. Some modern flasks are made of plastic so as to avoid detection by metal detectors.

Hip flasks can vary in shape, although they are usually contoured to match the curve of the wearer's hip or thigh for comfort and discretion in a design also known as a kidney flask, Some flasks have "captive tops" which is a small arm that attaches the top to the flask in order to stop it from getting lost when it is taken off.

A hip flask is most commonly purchased empty and then filled by the owner. However, the term "flask" also applies to smallest bottle sizes of alcohol in commercial markets. Some flasks come with small cups to make sharing easier, although generally liquid is consumed directly from the flask.

The hip flask began to appear in the form it recognized today in the 18th century. During the 18th century, women boarding docked British warships would transport gin into the ship via makeshift flasks, created from pig's bladders and hidden inside their petticoats.

In more modern times, people use hip flasks to transport alcoholic beverages into a wide variety of venues and events. However, because the hip flask is so commonly used to transport alcohol into venues or events, purveyors of such venues or events use bouncers or other individuals trained to recognize the hip flasks and confiscate the alcoholic beverages.

In response to the increased recognition of the hip flask as a vessel for transporting alcoholic beverages, individual wishing to transport alcohol may opt to use containers designed to hold other liquids to do so. For example, the Cruising industry is notorious for charging exorbitant amounts for alcoholic beverages given their captive audience of customers on a cruise ship. In such an instance, a customer may attempt to use a container configured to hold another liquid (i.e., a suntan lotion bottle, moisturizing lotion bottle, shampoo bottle, hair conditioner bottle, etc.) to inconspicuously transport an alcoholic beverage onto the cruise ship. Unfortunately, such a container can be easily determined to contain an alcoholic beverage by simply making the customer open the container to show the bouncer or other individual the content contained therein. As one of skill in the art will readily recognize, alcoholic beverages typically have a different smell and/or consistency than suntan lotion, moisturizing lotion, shampoo, or conditioner and are therefore easily distinguishable.

From the foregoing discussion, it should be apparent that a need exists for an apparatus, system, and method for concealing the contents of a container. Beneficially, such an apparatus, system, and method would, when opened, appear to contain the liquid designated on the container.

The present invention has been developed in response to the present state of the art, and in particular, in response to the problems and needs in the art that have not yet been fully solved by currently available liquid transporting containers. Accordingly, the present invention has been developed to provide an apparatus, system, and method for concealing the contents of a container that overcome many or all of the above-discussed shortcomings in the art.

FIG. 1 is a front view illustrating one embodiment of an apparatus 100 to conceal the contents of a container according to one embodiment of the present subject matter. The apparatus 100, in certain embodiments, includes a first container 102, and a second container 104. In an exemplary embodiment, the apparatus 100 also includes a cap 106.

In one embodiment, the first container 102, the second container 104 and the cap 106 are made of a plastic material. Materials suitable for constructing the container 102, the second container 104 and the cap 106 include High Density Polyethylene (HDPE), Low Density Polyethylene (LDPE), Polyethylene Terephthalate (PET, PETE or polyester), Polycarbonate (PC), Polypropylene (PP), Polystyrene (PS), Fluorine Treated (HDPE), and the like. In certain embodiments, the first container 102, the second container 104 and the cap 106 may be made of dissimilar materials. For example, in one embodiment, the first container 102 and the cap 106 is made of a plastic material, such as one of the plastics mentioned above, while the second container 104, at least in part, is made of a more pliable material such as a natural or synthetic rubber material.

As will be further discussed below, using materials having differing pliability's to construct the first container 102 and the second container 104 facilitates dispensing a liquid from within the second container 104 when the first container 102 is coupled to the second container 104 and the first container 102 is compressed. Accordingly, in certain embodiments, the first container 102 is made of a material having first pliability and the second container 104 is made of, at least in part, a material having a second, softer pliability.

Figure 2:
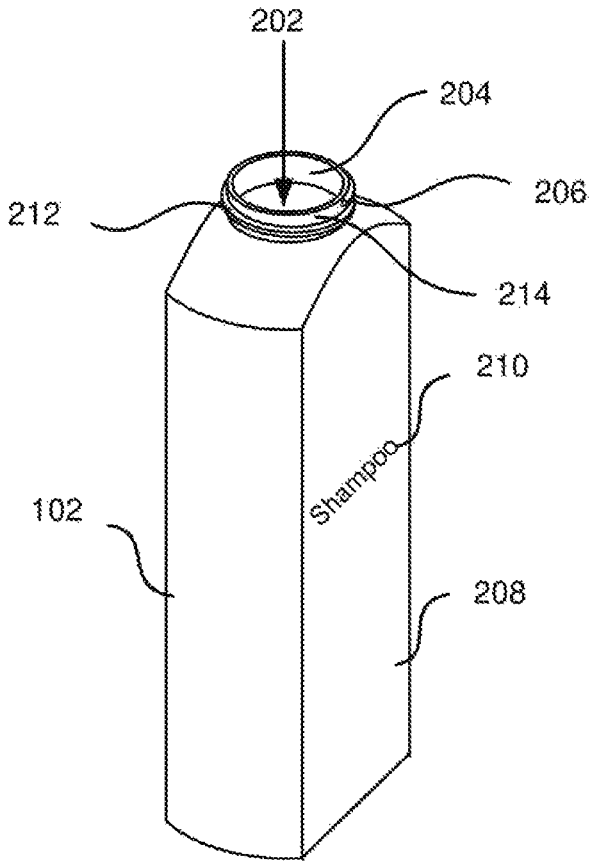
FIG. 2 is a top perspective view further illustrating the first container of FIG. 1 in accordance with one embodiment of the present subject matter.

FIG. 2 is a top perspective view further illustrating the first container 102 of FIG. 1 in accordance with one embodiment of the present subject matter. In one embodiment, the first container 102 includes a first container internal cavity 202, a first container opening 204, and a first container coupling element 206.

The first container internal cavity 202 is configured to hold a first liquid i.e., an alcoholic beverage. In such an embodiment, the first container 102 is made of a food grade plastic material i.e., HDPE, LDPE, PP or the like.

The first container 102, in certain embodiments, is shaped substantially similar to a conventional container to give the appearance of containing a liquid other than an alcoholic beverage. For example, in the embodiments depicted in FIG. 1 and Figure the first container 102 is shaped like a conventional shampoo bottle. In other embodiments, the first container 102 may be shaped to resemble other household liquid containers (i.e., a suntan lotion bottle, a moisturizing lotion bottle, a shampoo bottle, a hair conditioner bottle, etc.)

Thus, the first container 102 gives the appearance of containing a liquid that would not likely be confiscated by a bouncer or other individual upon entering a venue that confiscates external alcoholic beverages. In certain embodiments, to further enhance the look of an allowed substance, at least one exterior surface 208 on the first container 102 contains indicia 210 of a common household liquid. In the embodiments illustrated in FIG. 1 and FIG. 2, the first container 102 is marked as containing shampoo. In other embodiments, the first container 102 may be marked with other indicia 210 (i.e., sun tan lotion, moisturizing lotion, shampoo, hair conditioner, etc.)

In one embodiment, the first container opening 204 is defined by a generally cylindrical discharge portion 212. In an exemplary embodiment, the first container coupling element 206 comprises threads along an outer surface 214 of the cylindrical discharge portion 212 of the first container 102. In such an embodiment, the threads of the first container coupling element 206 are threadably engageable with threads that make up the second container coupling element 306 (See, FIG. 3A) on the second container 104 to selectively seal the first container opening 202 with the second container 104.

Figure 3A:
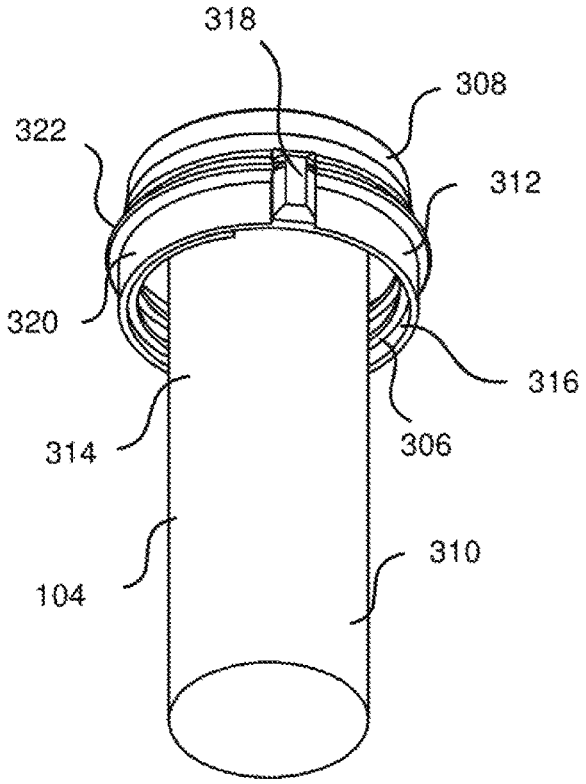
FIG. 3A is a top perspective view further illustrating the second container 104 of FIG. 1 in accordance with one embodiment of the present subject matter.
Figure 3B:
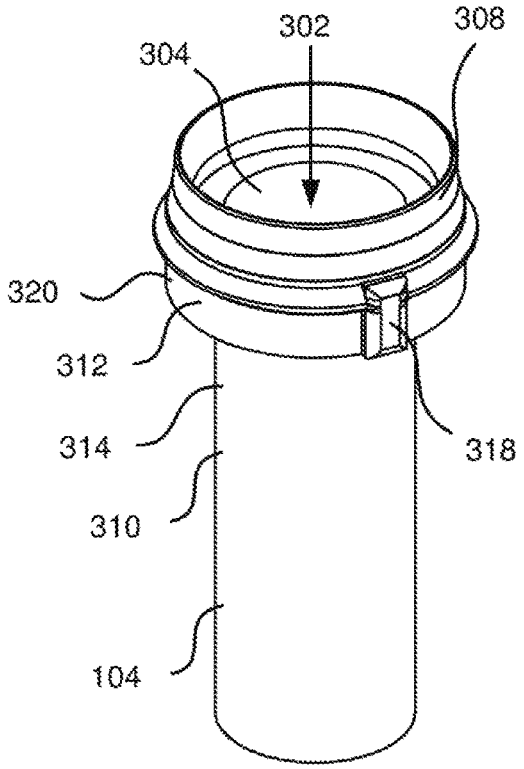
FIG. 3B is a bottom perspective view further illustrating the second container 104 of FIG. 1 in accordance with one embodiment of the present subject matter.

FIG. 3A is a top perspective view further illustrating the second container 104 of FIG. 1 in accordance with one embodiment of the present subject matter. FIG. 3B is a bottom perspective view further illustrating the second container 104 of FIG. 1 in accordance with one embodiment of the present subject matter. With reference to both FIG. 3A and FIG. 3B, in certain embodiments, the second container 104 includes a capping portion 308 and a containing portion 310.

The containing portion 310 of the second container 104 is receivable through the first container opening 204 in the first container 102 and into the first container internal cavity 202 in the first container 102. The capping portion 308, in certain embodiments, is larger than the first container opening 204 in the first container 102. Thus, only the containing portion 310 of the second container 104 is received within the first container internal cavity 202 in the first container 102 while the capping portion 308 of the second container is stopped at the first container opening 204 in the first container 102 by virtue of its size.

A second container coupling element 306 is engageable with the first container coupling element 206 to selectively couple the second container 104 to the first container 102. In the embodiments illustrated in FIGS. 3A and 3B, the second container coupling element 306 includes threads along an inner surface 316 of a cylindrical lip 312 that extends substantially parallel to a portion of an outer surface 314 of the containing portion 310 of the second container 104.

To seal the first container 102, the containing portion 310 of the second container 104 is inserted into the first container opening 204 in the first container 102 and into the first container internal cavity 202 in the first container 102 in the direction indicated by arrow 108 (See, FIG. 1). Once the capping portion 308 of the second container 104 is stopped at the first container opening 204 in the first container 102, the second container 104 is rotated in the direction indicated by arrow 110 to threadably engage the threads of the first container coupling element 206 with the second threads of the second container coupling element 306. In this manner, the threads along the outer surface 214 of the discharge portion 212 of the first container 102 are threadably engageable with the threads on the inner surface 316 of the cylindrical lip 312 of the second container 104 to selectively seal the first container opening 204. In certain embodiments, the second container 104 includes one or more finger tabs 318 to facilitate rotation of the second container 104.

When the first container coupling element 206 of the first container 102 is engaged with the second container coupling element 306 of the second container 104 to selectively couple the second container 104 to the first container, the second container 104 conceals the first container opening 204. Accordingly, anyone attempting to view the contents of the first container 102 is only able to see the contents of the second container 104. Therefore, in certain embodiments, while the first container internal cavity 202 is configured to hold an alcoholic liquid, the second container internal cavity 302 is configured to hold a suntan lotion liquid, a moisturizing lotion liquid, a shampoo liquid, a hair conditioner liquid, or the like. One of skill in the art will recognize that suntan lotion, moisturizing lotion, shampoo and hair conditioners typically have a pleasant aroma which may help to mask any scent arising from the alcoholic liquid contained within the first container internal cavity 202.

In an exemplary embodiment, the engagement between the threads along the outer surface 214 of the discharge portion 212 of the first container 102 and the threads on the inner surface 316 of the cylindrical lip 312 of the second container 104 forms a liquid tight seal of the first container internal cavity 202. Accordingly, when a pressure is applied to the outside of the first container 102 to squeeze the first container 102, the pressure decreases the volume of the first container inter al cavity 202. Because the second container 104 has sealed the first container internal cavity 202, the decrease in volume increases a first pressure inside the first container internal cavity 202. The increase in pressure inside the first container internal cavity 202 exerts pressure to the outside of the second container 104. The pressure applied to the outside of the second container 104 decreases a volume of the second container internal cavity 302 to force at least a portion of the second liquid though the second container opening 304. Therefore, anyone who squeezes the apparatus 100 attempting to examine the contents thereof will receive only the liquid contained within the second container internal cavity 302 (i.e., suntan lotion, moisturizing lotion, shampoo, hair conditioner, etc.) While the alcoholic liquid remains out of sight within the first container internal cavity 202.

As discussed above, in certain embodiments, the first container 102 is made of a plastic material, such as one of the plastics mentioned above, while the second container 104 is made of a more pliable material such as a natural or synthetic rubber material to facilitate dispensing a liquid from within the second container 104 when the first container 102 is coupled to the second container 104 and the first container 102 is compressed. In an exemplary embodiment, the second container is made of two materials having differing pliability's. In such and embodiment, the capping portion 308 of the second container 104 is made of a relatively rigid plastic material to facilitate coupling the capping portion 308 of the second container 104 to the outer surface 214 of the discharge portion 212 of the first container 102. The containing portion 310 of the second container 104 is made of a material that is softer and therefore more pliable than the relatively rigid plastic material of the capping portion 308 of the second container 104. Thus, when the first container 102 is coupled to the second container 104 and the first container 102 is compressed, the increased pressure within the first container internal cavity 202 increases pressure on the relatively softer containing portion 310 of the second container 104 to force liquid from within the second container internal cavity 302 through the second container opening 304.

Figure 4A:
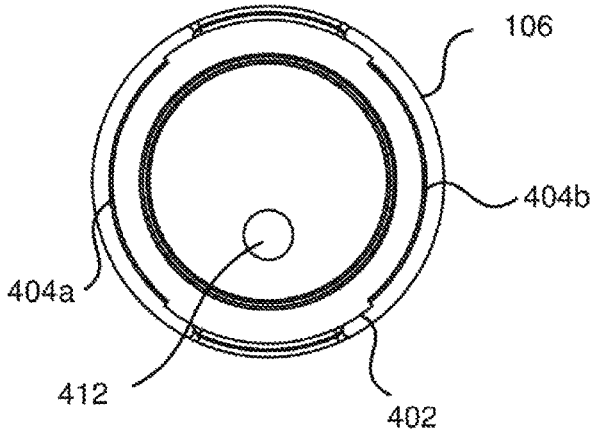
FIG. 4A is a bottom perspective view further illustrating the cap 106 of FIG. 1 in accordance with one embodiment of the present subject matter.
Figure 4B:
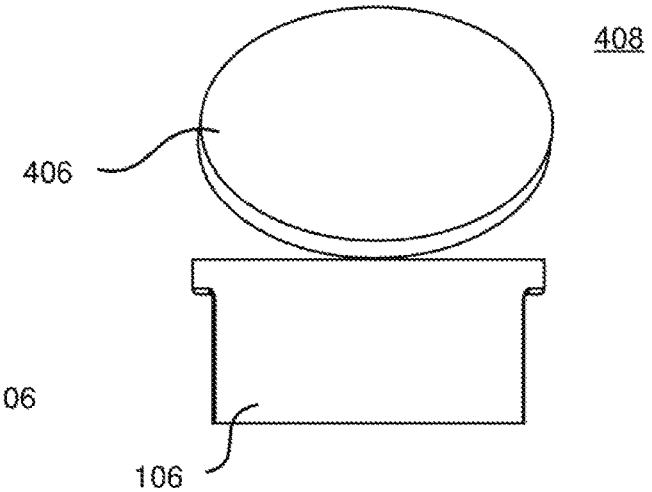
FIG. 4B is a side view further illustrating the cap 106 of FIG. 1 in accordance with one embodiment of the present subject matter.
Figure 4C:
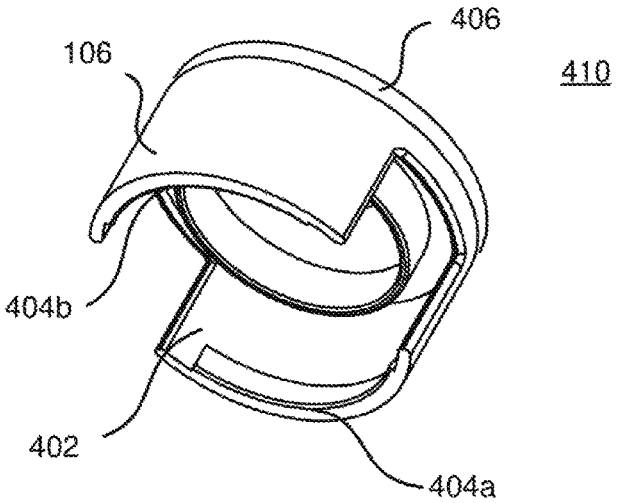
FIG. 4CA is a bottom perspective view further illustrating the cap 106 of FIG. 1 in accordance with one embodiment of the present subject matter.

FIG. 4A is a bottom perspective view further illustrating the cap 106 of FIG. 1 in accordance with one embodiment of the present subject matter. FIG. 4B is a side view further illustrating the cap 106 of FIG. 1 in accordance with one embodiment of the present subject matter. FIG. 4CA is a bottom perspective view further illustrating the cap 106 of FIG. 1 in accordance with one embodiment of the present subject matter.

In certain embodiments, the apparatus 100 of FIG. 1 includes a cap 106 configured to seal the second container opening 304 in the second container 104 to prevent liquid from escaping from the second container internal cavity 302. In such an embodiment, the cap 106 is coupleable to an outer surface 320 (See, FIGS. 3A and 3B) of the cylindrical lip 312 of the second container 104. For example, in one embodiment, a rim 322 (See, FIGS. 3A and 3B) extends perpendicularly from the outer surface 320 of the cylindrical lip 312 of the second container 104. In such an embodiment, an inner surface 402 of the cap 106 includes at least one projection 404*a* and 404*b* extending perpendicularly from the inner surface 402 of the cap 106 along at least a portion of the inner surface 402 of the cap 106. The projection(s) 404*a* and 404*b* on the inner surface 402 of the cap 106 are engageable with the rim 322 on the outer surface 320 of the cylindrical lip 312 of the second container 104 to selectively couple the cap 106 to the second container 104.

In an exemplary embodiment, the cap 106 includes a lid 406 hingedly coupled to the cap 106. The lid 406 is positionable between an open position 408, as shown in FIG. 4B, and a closed position 410, as shown in FIG. 4CA, to selectively seal the second container opening 304. To dispense a liquid from within the second container internal cavity 302, the lid 406 is flipped to the open position 408 and the first container 102 is compressed causing pressure to be applied to the second container 104 in a manner as described above. As the second liquid is forced from the second container internal cavity 302 it is forced through opening in the cap 106. Thus, the second liquid is expelled from within the second container internal cavity 302 in a manner substantially similar to the manner in which conventional suntan lotion, moisturizing lotion, shampoo, or conditioner is dispensed from a conventional suntan lotion bottle, moisturizing lotion bottle, shampoo bottle, or hair conditioner bottle.

The second container internal cavity 302 is configured to hold a second liquid i.e., sun tan lotion, moisturizing lotion, shampoo, hair conditioner, etc. It is understood that the above-described embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims. Further, it is contemplated that an embodiment may be limited to consist of or to consist essentially of one or more of the features, functions, strictures, methods described herein.

What is claimed is:

1. An apparatus to conceal the contents of a container, the apparatus comprising:

a first container having a first container internal cavity accessible through a first container opening, the first container internal cavity configured to hold a first liquid, the first container having a first container coupling element;

a second container having a second container internal cavity, the second container internal cavity configured to hold a second liquid through a second container opening, wherein at least a portion of the second container is receivable through the first container opening into the first container internal cavity in the first container, the second container having a second container coupling element;

a cap coupleable to an outer surface of the cylindrical lip of the second container;

wherein the first container coupling element of the first container is engageable with the second container coupling element of the second container to selectively couple the second container to the first container, wherein coupling the second container to the first container conceals the first container opening;

wherein the first container opening is defined by a generally cylindrical discharge portion and wherein the first container coupling element comprises threads along an outer surface of the cylindrical discharge portion and wherein the second container comprises a cylindrical lip extending substantially parallel with a portion of an outer surface of the second container; and wherein the second container coupling element comprises threads along an inner surface of the cylindrical lip, wherein the threads along the outer surface of the discharge portion of the first container are threadably engageable with the threads on the inner surface of the cylindrical lip of the second container to selectively seal the first container opening.

2. The apparatus of claim 1, wherein the first container has a flexible wall such that when a pressure is applied to the outside of the first container, there is a decrease in a volume of the first container internal cavity and an increase in a first pressure inside the first container internal cavity, wherein the increase in the first pressure inside the first container internal cavity exerts a second pressure to an outside wall of the second container.

3. The apparatus of claim 2, wherein the second pressure applied to the outside wall of the second container decreases a volume of the second container internal cavity to force at least a portion of the second liquid though the second container opening.

4. The apparatus of claim 1, wherein engagement of the first container coupling element with the second container coupling, element forms a liquid tight seal between the first container and the second container to seal the first container internal cavity.

5. The apparatus of claim 1, wherein engagement between the threads along the outer surface of the discharge portion of the first container and the threads on the inner surface of the cylindrical lip of the second container forms a liquid tight seal of the first container internal cavity.

6. The apparatus of claim 1, further comprising a rim extending perpendicularly from the outer surface of the cylindrical lip of the second container and wherein an inner surface of the cap includes at least one projection extending perpendicularly from the inner surface of the cap along at least a portion of the inner surface of the cap, wherein the projection on the inner surface of the cap is engageable with the rim on the outer surface of the cylindrical lip of the second container to selectively couple the cap to the second container.

7. The apparatus of claim 1, further comprising a lid hingedly coupled to the cap, wherein the lid is positionable between an open position and a closed position to selectively seal the second container opening.

8. The apparatus of claim 1, wherein the first container comprises a first material having a first pliability and wherein the second container comprises a second material having a second pliability and wherein compression of the first container compresses the second container when the second container is coupled to the first container.

9. The apparatus of claim 1, wherein the first container internal cavity is configured to hold an alcoholic liquid and wherein the second container internal cavity is configured to hold one of a suntan lotion liquid, a moisturizing lotion liquid, a shampoo liquid, and a hair conditioner liquid.

* * * * *